US005983773A

United States Patent [19]

Dionne

[11] Patent Number: 5,983,773

[45] Date of Patent: Nov. 16, 1999

[54] CHAMBERING OF LOW-ENERGY TRAINING AMMUNITION IN AUTOMATIC FIREARMS

[75] Inventor: Sylvain Dionne, Mirabel, Canada

[73] Assignee: SNC Industrial Technologies Inc./Les Technologies Industrielles SNC Inc., Quebec, Canada

[21] Appl. No.: 09/139,418

[22] Filed: Aug. 25, 1998

Related U.S. Application Data

[63] Continuation-in-part of application No. 08/863,078, May 23, 1997, and a continuation-in-part of application No. PCT/CA97/00174, Mar. 14, 1997.

[51] Int. Cl.[6] ..... F41A 21/10

[52] U.S. Cl. ..... 89/29; 89/162; 89/196; 42/77

[58] Field of Search ..... 89/161, 195, 196, 89/29, 162; 42/77

[56] References Cited

U.S. PATENT DOCUMENTS

| | | | |
|---|---|---|---|
| 472,377 | 4/1892 | Mallen | 89/161 |
| 886,211 | 4/1908 | Hino et al. | 89/161 |
| 4,608,909 | 9/1986 | Peters | 89/196 |
| 5,392,689 | 2/1995 | Buzzeo et al. | 89/196 |
| 5,433,134 | 7/1995 | Leiter | 89/196 |

FOREIGN PATENT DOCUMENTS

| | | | |
|---|---|---|---|
| 3063500 | 3/1991 | Japan | 89/161 |

*Primary Examiner*—Stephen M. Johnson
*Attorney, Agent, or Firm*—David J. French

[57] ABSTRACT

A barrel positioning spring moves a barrel in a blow-back operating pistol rearwardly when the slide recoils in order to position the chamber on the barrel to receive a further cartridge with the return of the slide. This spring in a Colt(™) .45 caliber pistol may be seated on the recoil spring guide rod present beneath the barrel. A removable loading ramp extension is fitted to the frame in the space between the chamber end and the next cartridge to receive such cartridge as it is being chambered by the returning slide.

3 Claims, 2 Drawing Sheets

CHAMBERING OF LOW-ENERGY TRAINING AMMUNITION IN AUTOMATIC FIREARMS

This application is a continuation-in-part of U.S. Ser. No. 08/863,078 filed May 23, 1997, and PCT/CA97/00174 (U.S.) filed Mar. 14, 1997.

FIELD OF THE INVENTION

This invention relates to the field of firearms and provisions for modifying semi-automatic firearms for training purposes. In particular, it relates to reliable chambering in firearms that have been modified to straight blow-back action so that they can fire low-energy training ammunition.

BACKGROUND TO THE INVENTION

In military and police firearms applications almost all of the ammunition consumed is used for training. For some training purposes, however, normal ammunition is not adequate. An alternative type of known training ammunition, represented by U.S. Pat. No. 5,359,937 (adopted herein by reference), fires a low-mass projectile relying on a special, low-energy cartridge designed to provide cycling of suitably-modified, recoil-operated automatic weapons.

An advantage of the low-energy training ammunition is that it has a shorter range and lower penetration capacity than standard ammunition. This permits use of smaller, less secure firing ranges as training facilities. If standard ammunition were accidentally employed in these facilities, unexpected dangers would arise from the increased striking power and range of such standard ammunition.

The weapon modifications required to permit cycling while firing low-energy training ammunition generally include replacing or modifying the barrel, and sometimes replacing or adding certain other components, depending on the weapon involved. These modifications also take safety into consideration. For example, in 9 mm automatic firearms, the caliber of the substitute barrel may be smaller than the diameter of the projectiles in standard 9 mm ammunition. If an attempt is made to chamber a standard round in such a training-adapted firearm, the design of the chamber and barrel will not normally permit entry of the standard projectile. This ensures that such modified weapons cannot fire standard, live ammunition.

Firearms of other calibers, such as caliber 0.45, may also be converted to fire the same low-energy training ammunition using similar training barrels as for converted 9 mm pistols.

The low-energy cartridge represented by U.S. Pat. No. 5,359,937, in combination with a substitute training barrel, provides recoil actuated cartridge case ejection through a pure blow-back action. Such a system, when firing appropriate marking cartridges, makes an effective close-range, force-on-force training system. Hits, which are on-lethal, are denoted by red, blue or other coloured marks. his system enhances the realism and training value of interactive scenario tactical training because it allows trainees to use their service weapons in a representative manner in exercises simulating, for example, counter-terrorism, close quarters combat, urban fighting, protection of dignitaries, trench clearing, and fighting in wooded areas.

When firing standard ammunition, with its abundant associated energy, it is necessary in many weapons, particularly handguns, to lock the barrel to the slide during the beginning of their rearward motion for a period long enough for the projectile to exit the barrel muzzle while the breech is still closed. This allows the chamber pressure to drop before the breech opens to eject the spent cartridge case. A locking mechanism couples the slide and barrel together for the first portion of the recoil, and then releases the slide. Thus, in such normal weapons, the barrel recoils, at least partially, with the slide. Upon unlocking, the slide continues its rearward travel while the barrel stops in the proper position to receive the next round from the magazine to be chambered.

In a training barrel it is necessary to omit this barrel-locking mechanism and, by so doing, the recoil action becomes pure blow-back of the slide only. This must be done because there is not enough energy in low-energy training cartridges to precipitate sufficient recoil to carry the barrel and the slide rearwardly in their standard configurations. A training barrel of the type addressed by this invention is similar in most aspects to the standard barrel for a particular pistol which normally relies on a barrel locking mechanism, but is modified, in part, by removing this locking mechanism, so that the barrel and the slide are no longer held together for the first portion of the recoil cycle.

In some converted pistols, however, after the barrel-locking mechanism has been removed so that the weapon can fire low-energy ammunition, as represented by U.S. Pat. No. 5,359,937, the barrel does not move rearward far enough, if at all, after firing to be in its normal position to receive the next round to be chambered. This happens precisely because the barrel is no longer locked to the slide, which would normally carry the barrel to the correct position before unlocking and leaving it there.

It is, therefore, an objective of this invention to provide a conversion barrel system for this class of firearm that will contribute to the proper positioning of the barrel for chambering.

A way to do this for certain 9 mm pistols, such as the Walther P-5, has been described in PCT Patent Application PCT/CA/00174 dated Mar. 14, 1997 and conceived by the same inventor as herein. The contents of this application, which designates the United States of America, are adopted herein by reference. This PCT application provides a system for the positioning of the barrel for chambering by adding a spring-loaded device to the bottom of the training barrel which, upon firing of the weapon, positively moves the barrel rearward to its required position for receiving the next cartridge from the magazine in a manner which is completely independent from the motion of the slide. The present invention does the same thing in part, but in a different mechanical configuration.

Even if the barrel were carried to its most rearward position, which is most favourable for chambering of the next cartridge, trouble-free chambering is not assured because the motion dynamics of the low-energy training cartridge as it leaves the magazine and enters the chamber are not the same as those of a service cartridge. This is due to the much lower weight of the training cartridge with its paucity of propellant and thin-walled plastic training projectile.

There is also a difference in weight distribution, which means that the center of gravity of the low-energy training cartridge is shifted rearwards compared to standard service cartridges with their greater amount of propellant and heavier metal projectiles. In addition, the external shape of the low-energy cartridge is not identical to that of service cartridges, and this too contributes to differences in the chambering process. The training cartridge may, therefore, require additional guidance as it moves from the magazine to the chamber to ensure that it does not jam during this high-speed transfer involving both vertical and horizontal movement. The invention herein, in one variant, addresses this consideration as well by providing a removable feed ramp extension to the end of the training barrel. The ramp must be removable with respect to the training barrel because it is not possible to insert it integrally with the training barrel without modifying the slide and/or the frame. Such modifications are not acceptable because the weapon must be capable of being reconverted back to the firing of service ammunition by simply removing the training barrel and reinserting the service barrel.

A second objective of the invention, therefore, is to provide a supplementary, moveable feed ramp between the magazine and the entrance to the chamber that will greatly increase the probability of proper chambering of the next low-energy training cartridge to be fired.

A way to do this for certain 9 mm pistols, such as the Sig 225, has been described in U.S. patent application Ser. No. 08/863,078, dated May 23, 1997, as conceived by the same inventor and adopted herein by reference. This application describes a system for ensuring proper chambering of low-energy training ammunition, as represented by U.S. Pat. No. 5,359,937, by fitting a removable ramp extension to the chamber end of a Sig 225 training barrel, such extension extending rearward towards the top of the magazine in such a fashion as to allow smooth passage from the magazine to the chamber of the next round to be fired. The present invention does the same thing in part, but by means of a different mechanical configuration.

The invention in its general form will first be described, and then its implementation in terms of specific embodiments will be detailed with reference to the drawings following hereafter. These embodiments are intended to demonstrate the principal of the invention and the manner of its implementation. The invention in its broadest and more specific forms will be further described, and defined, in each of the individual claims which conclude this specification.

SUMMARY OF THE INVENTION

This invention is directed to an automatic pistol adapted to fire low-energy training ammunition wherein a training barrel that omits the barrel-locking feature normally present is substituted in place of a standard service barrel. The invention firstly provides a system for the positioning of the training barrel for chambering by adding a spring that bears on the barrel which, upon firing of the weapon, positively moves the barrel rearward to its required position for receiving the next cartridge from the magazine. This occurs in a manner which is completely independent from the motion of the slide. Without this positioning mechanism, the training barrel would be too far forward from the top of the magazine and the incoming cartridge would not necessarily enter the chamber cleanly, hence provoking a weapon jam whenever such misalignment should occur.

According to one aspect of the invention, a firearm is provided with a slide and a training barrel which at no time are locked together during the firing cycle, and the training barrel is provided with a downwardly protruding lug preferably located under the chamber. In one variant this lug has two legs which longitudinally straddle a slide lock lever located transversely in the frame of the firearm and limit longitudinal motion of the barrel in at least one direction.

The firearm to which this invention is applicable is conventionally provided with a recoil spring which extends between the frame at its rearward end, and the slide at its forward, muzzle end. This recoil spring is conventionally located over a recoil spring guide rod aligned at its forward end by the slide and thrust rearwardly at its rearward end by the recoil spring to rest against the frame.

According to the invention, the recoil spring guide rod is provided at its rearward end with a small barrel positioning spring, nested within its core and acting along the same axis as the recoil spring, but passing above the surface of the frame to bear against the forward facing surface of the front leg of the training barrel lug.

When the weapon is in-battery and ready to fire, the barrel positioning spring is at maximum compression because the slide has pushed the training barrel to its farthest forward position during chambering of the low energy cartridge to be fired. When firing occurs, the slide recoils without pulling the barrel back with it. Even though there is nothing obstructing rearward movement of the barrel after the slide has recoiled, the barrel would normally not move rearwardly without the barrel positioning mechanism of the invention being present.

Rearward motion of the training barrel is effected by the barrel positioning spring as it bears on the forward facing surface of the front leg of the barrel lug, its spring force being expressed in the rearward direction because the recoil spring guide rod does not move relative to the frame.

Travel of the barrel with respect to the frame is limited by the combination of a slot present in the lower end of the barrel lug and a transverse pin mounted in the frame—conventionally, the "side lock lever"—which passes through the slot. This slot is bounded by the two downwardly directed legs that are extensions of the barrel lug. When the pistol is in-battery the slide lock lever restrains the frontward facing surface of the rear leg of the barrel lug, and when the slide is at its maximum rearward position the rearward facing surface of the rear leg of the lug is restrained by the frame, thus limiting rearward travel of the barrel. The latter configuration places the barrel at its most favourable position relative to the magazine for facilitating trouble-free chambering of the next round to be fired.

The mechanical characteristics of the barrel positioning spring in compression must be such that the spring will be capable of readily lengthening from its compressed state to move the barrel positively back to the required position for receiving the next round. The barrel is free to move rearwardly only while the slide is displaced rearwardly in its recoil cycle. The barrel positioning spring is only partially extended after rearward travel of the barrel ceases, providing a residual rearwardly-directed force so that the barrel will not move forward again until the slide of the weapon commences to chamber the next cartridge. Since the strength of the barrel positioning spring is much less than the strength of the recoil spring associated with the slide, the motion of the slide will not be impeded as it returns to close the chamber and push the barrel forward in preparation for firing of the next round. In doing so, this action of the slide recompresses the barrel positioning spring, readying it for the next cycle, as well as advancing the barrel to its forward, in-battery position.

As a further feature of the invention, an additional element for ensuring proper chambering of ammunition is provided by fitting a removable ramp extension to the chamber end of the training barrel. The bottom lip of the barrel chamber is slightly dished at the chamber entrance to form a normal feed ramp. The extension ramp is mounted on the frame and is directed rearwardly towards the top of the magazine to allow smooth passage from the magazine to the chamber of the next round to be fired. Without this ramp extension, the barrel chamber, even after being optimally positioned rearwardly by the barrel positioning spring, as described above, may be positioned too far from its standard position adjacent to the top of the magazine and the incoming cartridge may not necessarily enter the chamber cleanly, thereby having the potential to jam the weapon.

In the case of the Colt 0.45 caliber 1911 automatic pistol the feed extension ramp is fitted onto the frame and engages with the downwardly protruding lug under the chamber of the barrel by a sliding fit. The feed extension ramp in this case is provided with two forwardly facing arms, respectively slidingly fitted into longitudinal grooves formed on the right and left sides of the lug. The forwardly facing arms of the feed extension ramp position the upwardly facing guide surface of the ramp extension in line with the chamber. The extension ramp serves to fill the gap between the top of the magazine and the entrance to the chamber when the barrel has travelled to its most rearward position under the influence of the barrel positioning spring. When chambering of the next round to be fired occurs, the round is guided into the chamber by the extension as the slide moves forward into the firing position.

No modification is effected to either the slide or the frame. The feed ramp extension is removable and can be installed in some firearms by inserting (e.g. by first press fitting) it into the frame prior to the slide/training barrel assembly being attached to the frame. Upon assembling of the barrel into the frame, the feed ramp is seated so that it is aligned with the barrel, beneath the chamber.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
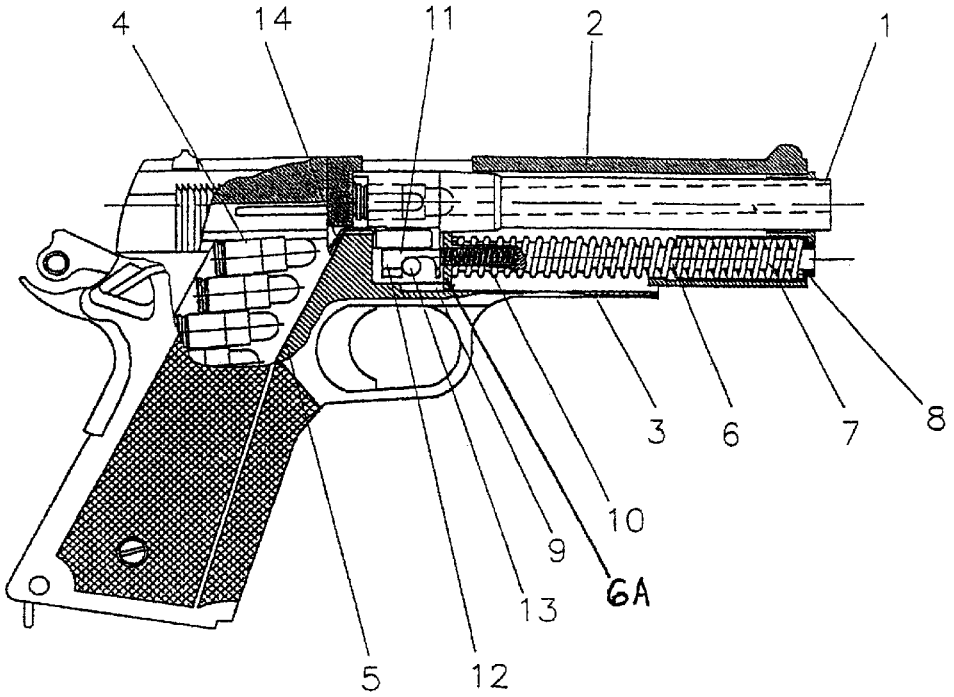
FIG. 1 is a partial cutaway, cross-sectional side-view of a caliber 0.45 pistol modified to fire low-energy ammunition, as represented by U.S. Pat. No. 5,359,937, with a fully-chambered low-energy cartridge.

In FIG. 1 a 9 mm training barrel 1 is shown mounted in a standard 0.45 caliber slide 2 which is assembled to a standard 0.45 caliber frame 3 so that the converted weapon will fire low-energy training ammunition 4, as represented by U.S. Pat. No. 5,359,937, loaded from 9 mm training magazine 5. Recoil spring guide rod 6, upon which recoil spring 7 is mounted, is firmly anchored between the slide-mounted barrel bushing 8 at the muzzle end and shoulder 9 of frame 3 such that recoil spring guide rod 6 is immobilized with respect to frame 3 by the pressure that the recoil spring 7 applies to the flange 6A on the guide rod 6. Enlarged flange 6A on the guide rod 6 abuts the shoulder 9 on the frame 3 to effect this immobilization.

Figure 2B:
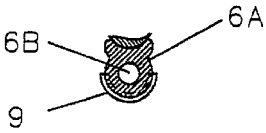
FIG. 2B shows a cross section of this barrel at the point where the barrel positioning spring passes above the frame to contact the barrel.
Figure 2A:
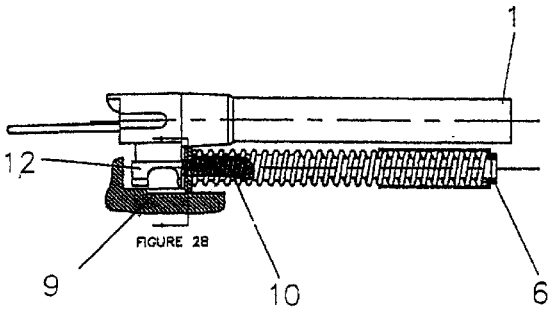
FIG. 2A is a side view of the 9 mm training barrel used in the modified caliber 0.45 pistol of FIG. 1 in combination with its recoil spring, recoil spring guide rod and barrel positioning spring.
Figure 2C:
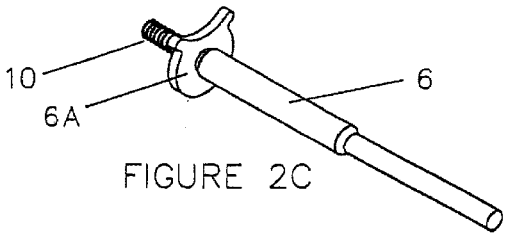
FIG. 2C is a perspective view showing details of the recoil spring guide rod with the barrel positioning spring in place.

FIGS. 2A, 2B and 2C show barrel positioning spring 10 seated and carried within a bore 6B in the rearward end of recoil spring guide rod 6. The protruding end of this spring 10 bears against the forward facing surface of barrel lug 11. Barrel positioning spring 10 and recoil spring guide rod 6 are assembled by loosely inserting the positioning spring into the hole 6B drilled in the rearward face of the guide rod. Positioning spring 10 is then compressed by spring guide rod 6 as the sub-assembly, spring 10 and rod 6 (FIG. 2C), is pushed into place against the forward face of lug 11.

The weapon configuration in FIG. 1 is in-battery with recoil spring 7 at maximum extension and barrel positioning spring 10 in maximum compression. When in-battery, training barrel 1 is in its most forward position with the forward facing surface of rear leg 12 of barrel lug 11 abutting transverse slide lock lever 13 mounted in frame 3.

Figure 3:
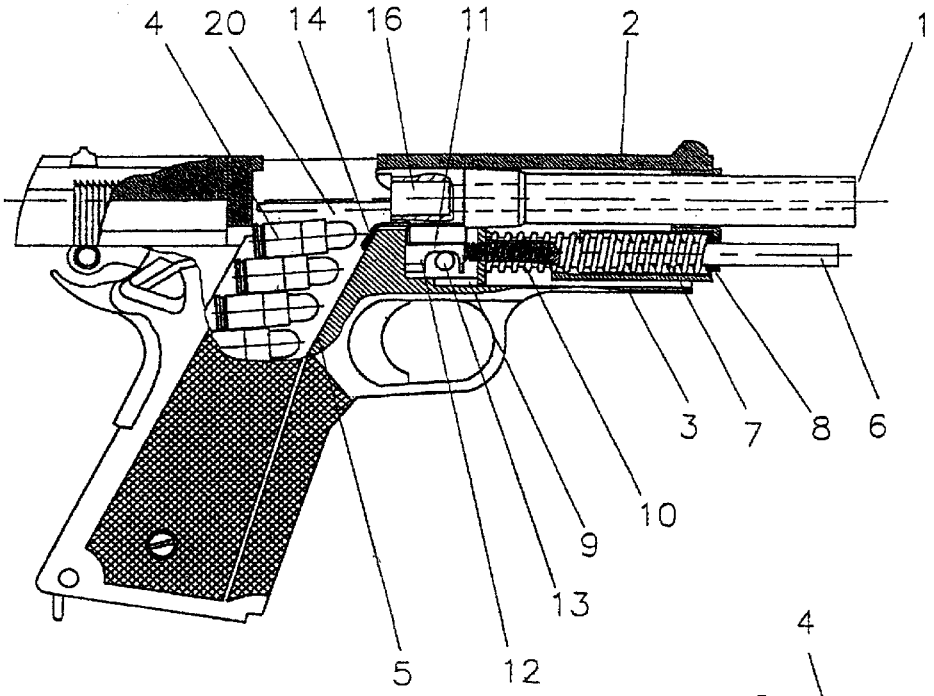
FIG. 3 shows the pistol of FIG. 1 after firing with the slide in its most rearward position, ready to be moved forward by the recoil spring. The spent case from the chambered low-energy training cartridge of FIG. 1 after firing has been ejected from the weapon and the next cartridge from the magazine is in position to be chambered by the returning slide.

Rearward movement of training barrel 1 from its forward position after firing is effected by barrel positioning spring 10, which is in compression at the time of firing. Since recoil spring guide rod 6 does not move relative to frame 3, barrel positioning spring 10 is constrained to expand rearward only. As soon as slide 2 has completed its initial movement rearwardly (under the influence of the expanding cartridge case as detailed in U.S. Pat. No. 5,359,937) the training barrel 1 is unfettered because the two components are not locked together. At this moment the rearward-directed force provided by compressed barrel positioning spring 10 pushes training barrel 1 rearwardly until the barrel 1 is brought to a stop when the rearward facing surface of rear leg 12 of barrel lug 11 abuts frame 3, as illustrated in FIG. 3. Training barrel 1 is thus at its most rearward position with the entrance to chamber 16 being located just above and forward of the top of magazine 5. This is the preferred position for receiving the next round to be chambered from magazine 5.

The forward motion of slide 2, which first chambers the next training cartridge 4 to be fired, then picks up training barrel 1 in the normal manner of the firing cycle (FIG. 3A) and moves it forward to the in-battery position ready for firing of the next round. This compresses the barrel positioning spring 10 and readies it for the next cycle, as shown in FIG. 1.

Also shown in FIG. 1 is feed ramp extension 14, which is separately inserted into and rigidly held by frame 3. Arms 17 of the feed ramp extension slidingly fit around barrel lug 11 as depicted in FIGS. 4A, 4B, 4C and 4D. Feed ramp extension 14 is a separate piece, non-integral with barrel lug 11, because the training barrel 1 and feed ramp extension 12 cannot be otherwise assembled into the weapon without modification to either or both of slide 2 and frame 3.

Figure 4D:
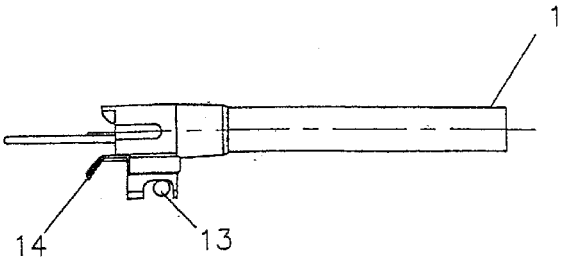
FIG. 4D shows the barrel of FIG. 4A and its position relative to the slide lock lever when the barrel is in its most rearward position.
Figure 4A:
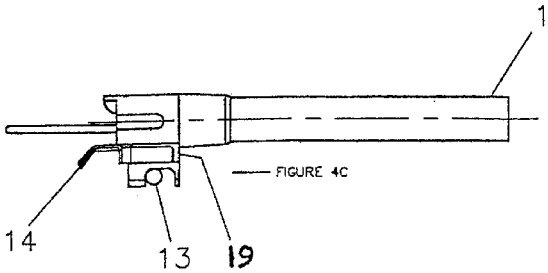
FIG. 4A is a side view of the 9 mm training barrel used in the modified caliber 0.45 pistol of FIG. 1 in combination with its removable feed ramp extension and its position relative to the slide lock lever when in-battery.
Figure 4C:
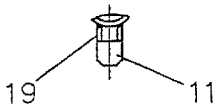
FIG. 4C is a partial end view showing the grooves in the barrel lug into which the arms of the feed ramp extension are slidingly fitted.
Figure 4B:
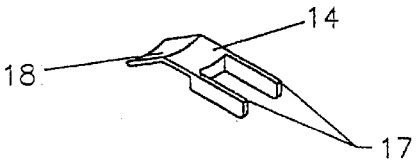
FIG. 4B depicts the feed ramp extension in perspective view.

In FIG. 4A training barrel 1 is in the in-battery position relative to slide lock lever 13, as described above and also shown in FIG. 1. After firing, when training barrel 1 is in its most rearward position, the relation of slide lock lever 13 to training barrel 1 is shown in FIG. 4D, again as described above and also shown in FIG. 3. FIG. 4B depicts feed ramp extension 14 with arms 17 at its forward end and upwardly facing guide surface 18 at its rearward end. Barrel 1 is able to move relative to feed ramp extension 14 because grooves 19 formed in the sides of lug 11 are slidingly fitted between arms 17 of feed ramp extension 14, as shown in FIG. 4C. Feed ramp extension 14 may be made of tempered steel.

Figure 3A:
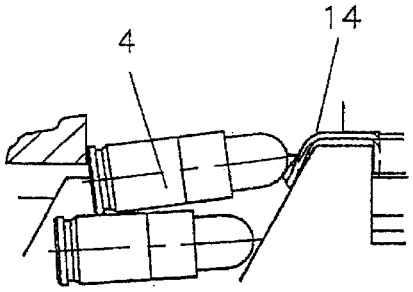
FIG. 3A is a cut away section of the weapon showing the next cartridge to be chambered in relation to the feed ramp extension just after the slide begins to move forward.

The presence of feed ramp extension 14 may be required even after barrel positioning spring 10 has placed training barrel 1 in the most favourable rearward position as possible for chambering of the next low-energy cartridge 4, as described above and illustrated in FIG. 3. The gap between the entrance to chamber 16 and the nose of projectile 20 of low-energy cartridge 4 may still be too large for reliable chambering without the presence of feed ramp extension 14, which fills the gap, as shown in FIG. 3. The next low-energy cartridge 4 from magazine 5 will, therefore, be smoothly guided by upwardly facing guide surface 18 of feed ramp extension 14 into chamber 16 when slide 2 moves forward to its in-battery position of FIG. 1. This action is shown in FIG. 3A wherein the returning slide has advanced the cartridge 4 into contact with the ramp extension 14.

The functioning of the combination of the subject barrel positioning mechanism and subject ammunition loading mechanism has been tested many hundreds of times with complete success and reliability in Colt 0.45 1911 pistols converted to fire 9 mm low-energy training ammunition as represented by U.S. Pat. No. 5,359,937. Individually or in combination, these two mechanisms are also applicable to other semi-automatic firearms that fire low-energy ammunition, including blanks.

CONCLUSION

The foregoing constitutes a description of specific embodiments showing how the invention may be applied and put into use. These embodiments are only exemplary. The invention in its broadest and more specific aspects is further described and defined in the claims which now follow. These claims, and the language used therein, are to be understood in terms of the variants of the invention which has been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A training barrel conversion kit for an automatic pistol having a frame, a cartridge magazine having a top end and containing cartridges each with a cartridge nose end and a slide that is free to move rearwardly, independently of the barrel, comprising:

(a) a training barrel with muzzle and chamber ends incorporating a chamber with a chamber entrance at the chamber end, and having a protrusion in the form of a barrel lug extending laterally from the barrel;

(b) a barrel positioning spring that is coupled to the frame and bears on the barrel lug;

(c) a recoil spring positioned to thrust the slide in the forward direction with respect to the frame, the strength of the recoil spring being greater than the strength of the barrel positioning spring;

(d) a recoil spring guide rod positioned within the recoil spring, said guide rod being thrust at its rearward end by the recoil spring rearwardly against the frame;

wherein said barrel positioning spring is installed at the rearward end of the recoil spring guide rod and is seated thereon in a compressed state to apply its force of expansion rearwardly against the forward facing surface of the training barrel lug, whereby, upon firing of the weapon, the barrel positioning spring moves the barrel rearward to a position for receiving the next cartridge from the magazine.

2. A conversion kit as in claim 1 further comprising a removable ramp extension to the chamber end of the training barrel, said ramp extension being positioned with respect to the barrel to extend rearward towards the top end of the magazine, said feed ramp extension having an upwardly facing guide surface in the form of a smooth concave groove positioned between the nose of the next most proximate cartridge in the magazine and the chamber entrance to allow smooth passage from the magazine to the chamber of the next cartridge to be fired.

3. A conversion kit as in claim 2 wherein the feed ramp extension is:

1) fitted onto the frame of the pistol;

2) provided with two forwardly facing arms which are slidingly engaged with the downwardly protruding lug under the chamber of the barrel said arms being respectively slidingly fitted into longitudinal grooves on the sides of the lug whereby relative displacement of the barrel lug with respect to the forwardly facing arms of the feed extension ramp positions the upwardly facing guide surface of the ramp extension at the entrance to the chamber.

* * * * *